US005321218A

United States Patent [19]

Vause

[11] Patent Number: 5,321,218

[45] Date of Patent: Jun. 14, 1994

[54] ELECTRICAL CONNECTORS

[75] Inventor: Francis Vause, Lancashire, England

[73] Assignee: First Thought Development Ltd., Lancashire, England

[21] Appl. No.: 916,141

[22] PCT Filed: Jan. 31, 1991

[86] PCT No.: PCT/GB91/00146

§ 371 Date: Sep. 18, 1992

§ 102(e) Date: Sep. 18, 1992

[87] PCT Pub. No.: WO91/11836

PCT Pub. Date: Aug. 8, 1991

[30] Foreign Application Priority Data

Jan. 31, 1990 [GB] United Kingdom ..... 9002136

[51] Int. Cl.[5] ..... H01R 33/96

[52] U.S. Cl. ..... 200/51.09; 200/43.11; 200/540; 200/542; 200/325; 439/188

[58] Field of Search ..... 200/43.02, 43.11, 43.04, 200/43.01, 43.16, 51.1, 51.09, 51.14, 51.16, 537, 538, 539, 540, 329, 334, 323, 324, 325, 51.13, 542; 439/188

[56] References Cited

U.S. PATENT DOCUMENTS

| | | | |
|---|---|---|---|
| 1,314,050 | 8/1919 | Douglas | 200/539 X |
| 3,020,366 | 2/1962 | Dolph | 200/51.16 |
| 3,582,584 | 6/1971 | Best | 200/51.16 X |
| 3,801,767 | 4/1974 | Marks | 200/334 X |
| 3,915,536 | 10/1975 | Glantz | 439/188 |
| 4,093,336 | 6/1978 | Rose | 200/51.14 X |
| 4,306,126 | 12/1981 | Howard | 200/539 X |
| 5,190,148 | 3/1993 | Williams | 200/334 X |

FOREIGN PATENT DOCUMENTS

| | | | |
|---|---|---|---|
| 2110481 | 6/1993 | United Kingdom | 439/188 |

*Primary Examiner*—Glenn T. Barrett

*Attorney, Agent, or Firm*—Pollock, Vande Sande & Priddy

[57] ABSTRACT

An electrical connector, for example a lampholder comprises an on/off switch mechanism including a push bar. The connector further comprises a locking arrangement including an interlock member which extends to the pushbar and moves into and out of cooperation with an aperture in the pushbar. When a cooperating device, for example a lamp, is inserted into the connector the interlock member moves axially into the lampholder to a position at which the pushbar is free to move between "on" and "off" positions. When no cooperating device is connected, the interlock member prevents movement of the pushbar. The pushbar and the interlock member include respective inclined surfaces arranged such that the pushbar will be moved to the "off" position when a cooperating device is removed from the connector.

9 Claims, 4 Drawing Sheets

ELECTRICAL CONNECTORS

FIELD OF THE INVENTION

The invention relates to electrical connectors and is particularly, though not exclusively, related to electrical lampholders.

BACKGROUND OF THE INVENTION

Electrical lampholders generally comprise a securing arrangement by which a lamp may be secured in the lampholder. At least one contact, in the form of a biased plunger, for example, is usually provided to deliver electrical power to the lamp. Some lampholders also include an on/off switch mechanism by which electrical power to the lamp can be switched on and off by a user. In most known lampholders, the switch mechanism is arranged such that it can be switched on and off irrespective of whether or not there is a lamp in the lampholder. However, it has recently been recognized that this can give rise to a potentially dangerous situation where for example the switch mechanism is switched on without a lamp or other device in the lampholder. Under these circumstances, the electrical power delivery contact or contacts of the holder will be exposed, and this can result in electrocution of a person who inadvertently touches the contact.

One solution to this potentially dangerous situation is disclosed in British Patent Application GB-A-2,207,818. This patent specification describes a bayonet bulb holder in which a so-called shutter element cooperates with a transverse bar which forms part of a switch mechanism to prevent the bulb holder from being switched on unless a bulb is inserted in the holder. A peg on the shutter element engages with a slot in the transverse bar to inhibit movement of the bar. When a bulb is inserted in the holder, bayonet lugs thereon effect rotation of the shutter element, causing the peg to move away from the slot in the transverse bar and thereby releasing the bar to be switched to its "on" position. The transverse bar and the peg are further arranged to prevent rotation of the shutter element when the bar is in its "on" position. In this way, removal of a bulb is prevented unless the switch mechanism is in its "off" position.

While the bulb holder disclosed in GB-A-2,207,818 provides a solution to the problem of electrically live contacts being exposed, it is a limited solution in that there is still one potentially dangerous situation which appears to have been overlooked. This situation could arise when a bulb burns out in the bulb holder while the switch mechanism of the bulb holder is on. Under these circumstances, a person wishing to change the bulb, and who is unaware or has forgotten that the switch mechanism must be switched off before the bulb can be removed, may try to force the bulb out of the bulb holder. This may result in the bulb breaking and thereby exposing live wires within the bulb.

We have previously addressed this problem of live contacts being exposed in our as yet unpublished British Patent Application No. 8914956.1, the teachings of which are incorporated herein by reference. The lampholder disclosed in patent application includes an interlock tube having an arm extending therefrom, which arm co-operates with a slot in a pushbar to prevent movement of the pushbar unless a bulb is inserted in the lampholder. As a bulb is inserted in the lampholder the interlock tube is rotated, thereby moving the arm out of the slot and releasing the pushbar for movement between its "on" and "off" positions.

Our previously proposed lampholder also incorporates a means by which the pushbar is moved automatically to its "off" position as a bulb is removed. A camming surface is provided on the pushbar in association with the slot. The camming surface is arranged such that, as a bulb is removed rotation of the interlock tube causes the arm to act against the camming surface, thereby urging the pushbar to its off position. Thus, our previously proposed lampholder, in addition to providing a means by which the pushbar is prevented from being switched to its "on" position unless there is a bulb in the holder, also provides a means by which the pushbar is moved automatically to its "off" position as a bulb is removed from the holder.

Our previously proposed lampholder provides a further solution to the problem of exposed live contacts, but is best suited for use with bayonet-type connections because the angular movement associated with bayonet-type connections is well suited to importing angular movement to the interlock tube. However, our previously proposed lampholder and the bulb holder described in the abovementioned GB-A-2,207,818 are not particularly well suited for use with so-called edison screw connections in which a screw threaded cap cooperates with a similarly threaded member on the lampholder.

SUMMARY OF THE INVENTION

The present invention aims to overcome this limitation by providing a solution to the aforementioned problem which is readily adaptable for use either with bayonet-type connections or with edison screw connections.

According to one aspect of the invention, there is provided an electrical connector having an on/off switch mechanism and wherein a locking means is provided for locking the on/off switch mechanism to prevent the mechanism from being moved to its "on" position when the connector is disconnected from a cooperating device, the locking means comprising a locking member having an elongate interlock member extending therefrom to said switch mechanism, which locking member is arranged to move axially in cooperation with the cooperating device upon insertion thereof and thereby to move the interlock member axially to a position in which movement of the switch mechanism to its "on" position can be effected.

According to another aspect of the invention, there is provided an electrical connector having an on/off switch mechanism, the connector comprising an actuating means for actuating the switch mechanism, which actuating means comprises an elongate member which moves longitudinally when a cooperating device is removed from the connector and thereby causes the mechanism to move to its "off" position.

The above and further features of the invention are set forth with particularity in the appended claims and, together with advantages thereof, will become clearer on consideration of a detailed description of exemplary embodiments of the invention made with reference to the accompanying drawings.

DETAILED DESCRIPTION OF EMBODIMENTS OF THE INVENTION

Figure 1:
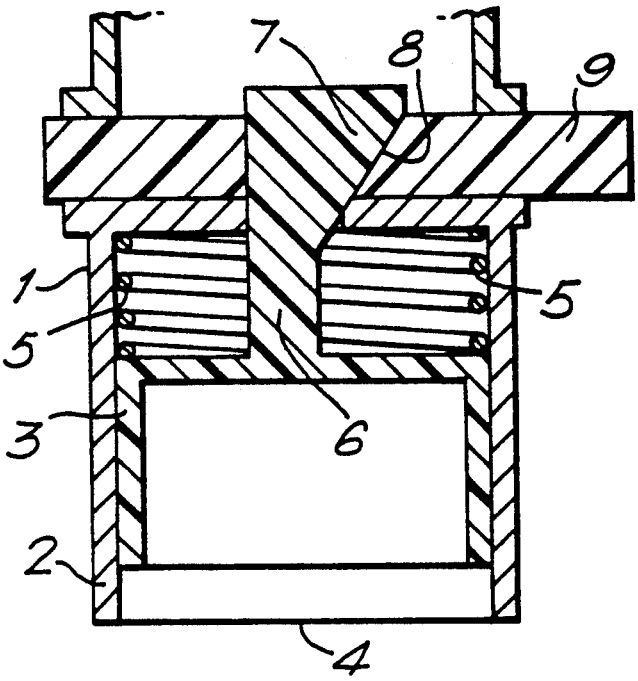
FIG. 1 is a schematic sectional view of a first embodiment of a lampholder having a switch mechanism locked in its "off" position.

Referring now to FIG. 1 of the accompanying drawings, which shows a schematic sectional view of major components of a lampholder, it will be seen that the lampholder comprises a body 1 having a lamp receiving portion 2 and an interlock sleeve 3 coaxial therewith.

Figure 2:
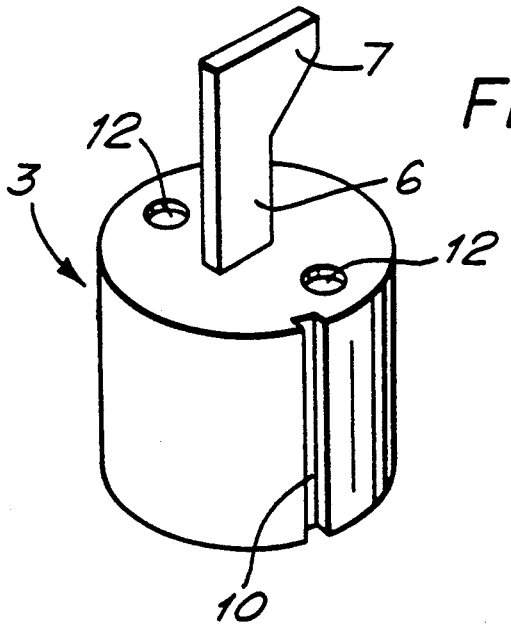
FIG. 2 is a perspective view of an interlock sleeve used in the lampholder of FIG. 1.

The lamp receiving portion 2 may be adapted to receive a bayonet-type lamp connection by the inclusion of bayonet lug receiving slots (not shown) or it may be adapted to receive an edison screw-type lamp connection by the inclusion of a screw threaded portion (not shown). The interlock sleeve 3, which is shown in perspective in FIG. 2, is made from an electrically insulating plastic material or the like and is dimensioned to fit snugly within the receiving portion 2. The interlock sleeve 3 is biased toward the open end 4 of the receiving portion 2 by way of a spring or springs 5 positioned between the main body 1 and the interlock sleeve 3. The interlock sleeve 3 also includes a locking member 6 which may be integrally formed. A wedged end portion 7 of the locking member 6 extends through a suitably formed aperture 8 in a switch pushbar 9.

As can be seen from FIG. 2, the interlock sleeve 3 may also include a keyway 10 arranged to co-operate with a suitably positioned key (not shown) on the body 1 to prevent rotation of the interlock sleeve as a bulb is inserted into the holder. However, it will be appreciated that the key and keyway are not strictly necessary because, as can be seen from FIG. 3 the aperture 8 in the pushbar 9 can be formed to be similar to the section of the interlock member 6, e.g., rectangular, in order to prevent rotation of the interlock sleeve 3. Cooperation between the wedged end portion 7 and the pushbar 9 can also serve to prevent the interlock member 3 from being urged through the open end 4 of the receiving portion 2. However, if required, a further detent means may also be provided, e.g., in the form of limiting flanges (not shown) in the vicinity of the open end 4. Alternatively, and to the same end, the keyway 10 may be adapted to include an endstop which acts against the associated key to limit movement of the interlock member 3.

Figure 3:
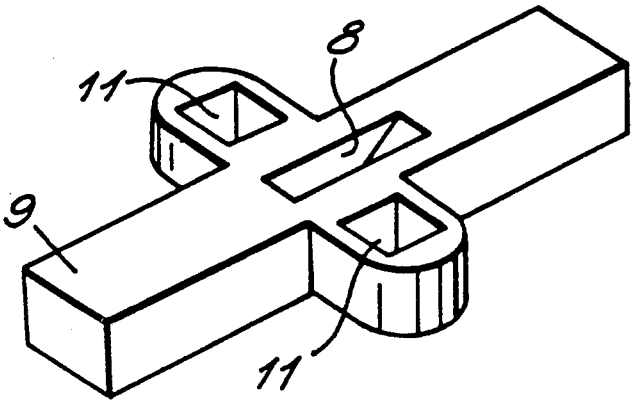
FIG. 3 is a perspective view of a pushbar used in the lampholder of FIG. 1.

As shown in FIG. 3, the pushbar 9 includes apertures 11 for receiving terminal contactors (not shown) by which electrical power is delivered to a biased plunger or plungers (also not shown) which extend through apertures 12 in the interlock sleeve 3 (see FIG. 2). The biased plunger or plungers are, of course, provided to make electrical contact with a lamp when it is inserted into the lampholder.

Returning now to FIG. 1, it can be seen that when there is no lamp in the lampholder the interlock sleeve 3 is urged toward the open end 4 of the receiving portion 2 by the spring or springs 5. In this position the wedged end portion 7 of the interlock member 6 is positioned in the aperture 8 to prevent transverse movement of the pushbar 9. It should be appreciated that in the position shown in FIG. 1, contactors (not shown) on the pushbar, 9 will not make an electrical connection with the biased plungers. In other words, the pushbar is in its "off" position.

Figure 4:
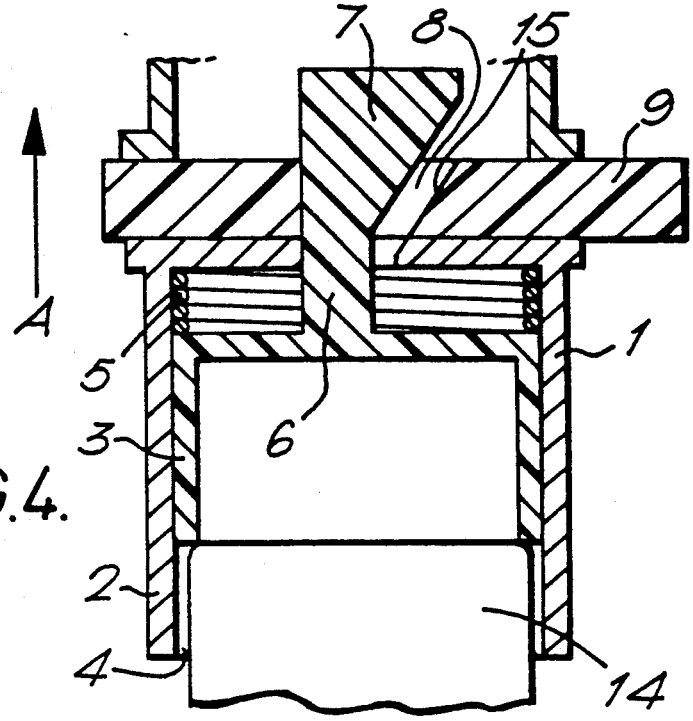
FIG. 4 is a schematic sectional view of the first lampholder with the switch mechanism unlocked and in its "off" position.
Figure 5:
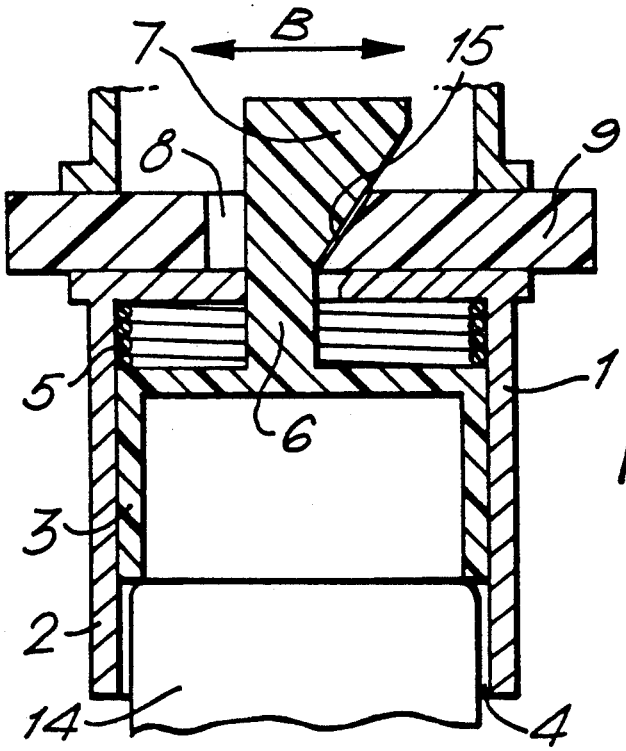
FIG. 5 is a schematic sectional view of the first lampholder with the switch mechanism unlocked and in its "on" position.

As can be seen in FIGS. 4 and 5, when a lamp bulb 14 is inserted into the holder, the end thereof comes into contact with the interlock sleeve 3 so that the sleeve 3 is urged into the body in the direction of arrow A against the bias of the spring or springs 5. Movement of the interlock sleeve 3 into the body causes the wedged end portion 7 also to move in the direction of arrow A and clear of the aperture 8 in the pushbar 9. When the wedged end portion 7 is in this position, the pushbar is in effect unlocked from the wedged end portion 7 and is free to be moved in the direction of transverse arrow B between its "off" position, as shown in FIG. 4, and its "on" position, as shown in FIG. 5. In this way, the interlock member 6 in cooperation with the aperture 8 in the pushbar 9 provide a means by which the pushbar is prevented from being moved to its on position unless a lamp or other cooperating device is connected to the lampholder.

Furthermore, in the event that a person attempts to remove the lamp 14 from the lampholder when the pushbar 9 is in its "on" position, as shown in FIG. 5, the pushbar 9 will move to its "off" position automatically. As the lamp 14 is removed from the holder, the interlock sleeve 3 is urged by the spring 5 toward the open end 4. At the same time, the wedged end portion 7 moves back into the aperture 8 and cooperates with an angled face 15 to urge the pushbar 9 to its "off" position, as shown in FIG. 1. Thus, the interlock member 7 in cooperation with the aperture 8 also provides a means by which the pushbar 9 is urged automatically to its "off" position when a lamp or other cooperating device is removed from the lampholder.

It should be appreciated that the above described embodiment of the invention is well suited for use either with a bayonet-type connection or with a screw type connection, since it relies upon axial movement, as opposed to angular movement, to provide the locking function. This may be advantageous in terms of tooling and other manufacturing costs because the same components can be used for either type of connection, with any modifications generally being limited to dimensional variations.

Further refinements, such as detent members on or associated with the pushbar to prevent additional movement of the pushbar beyond its "on" and "off" positions, and such as a camming arrangement on or associated with the pushbar to provide a positive switching or "click" action to the pushbar between the "on" and "off" positions, are felt to be well within the knowledge of those skilled in the art and accordingly are not described herein in any detail. In any case, a detailed description exemplary of such refinements is to be found in our abovementioned previous application.

Figure 6:
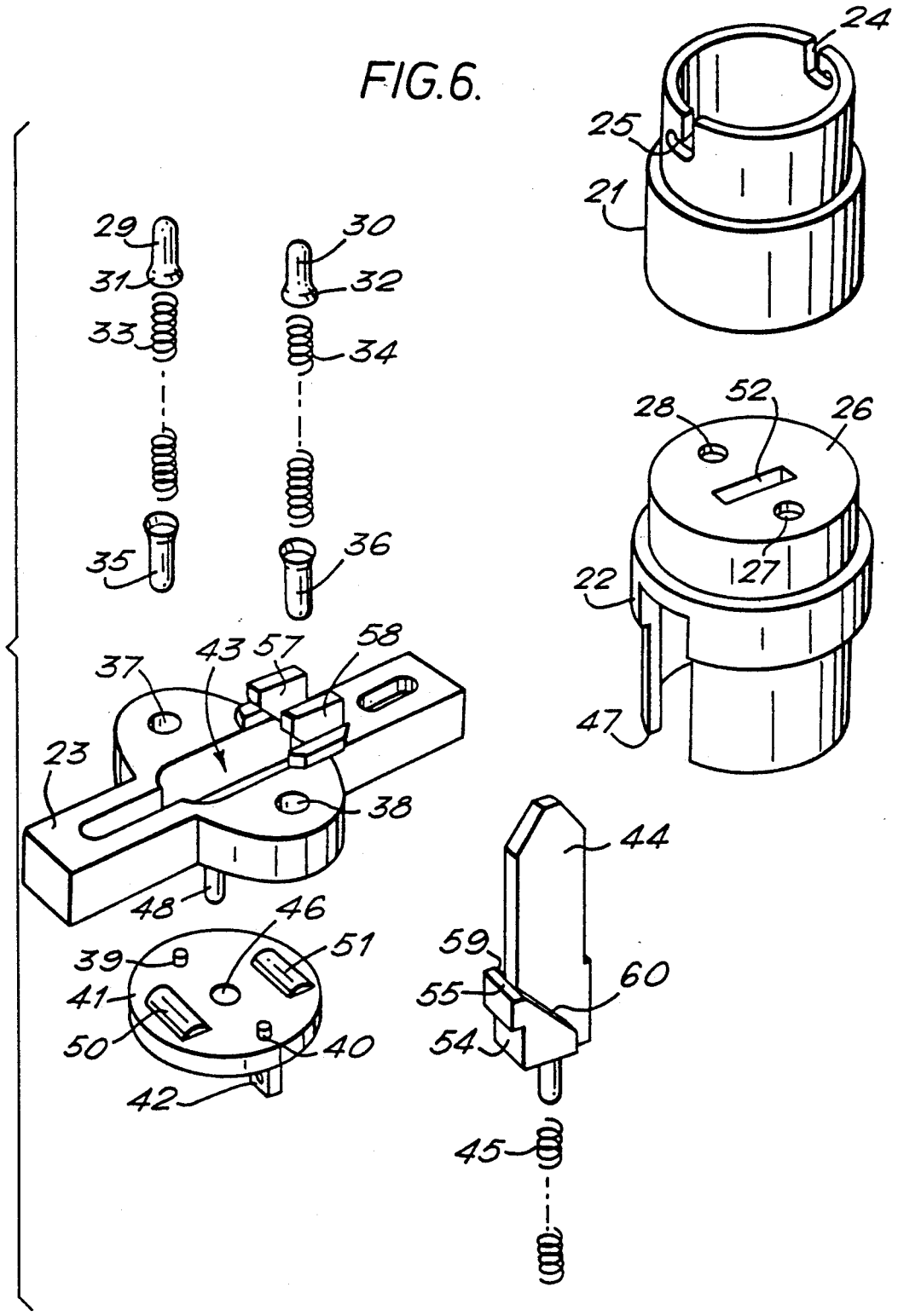
FIG. 6 is a perspective exploded view of the major components of a second embodiment of a lampholder.

FIG. 6 shows an exploded perspective view of another embodiment of lampholder which comprises a lamp retaining member 21 made from a conducting material such as brass, the main body 22 and a pushbar 23. Bayonet lug retaining slots 24, 25, are shown in the retaining member 21 for cooperation with bayonet lugs on a lamp connector (not shown). It should be appreciated from the description that follows that this embodiment also is well suited for use with an edison screw-type lamp connector, and the retaining member 21 thus may be replaced by a retainer designed to suit such a connection.

The retaining member 21 fits securely onto the main body 22, with the end face 26 of the main body 22 defining a supporting wall within the retaining member. Two apertures 27, 28 are defined in the end face 26 and respective plungers 29, 30 extend there, through to make electrical connection with terminals of a lamp when a lamp is inserted into the retaining member 21. Flanged end portions 31, 32 on each respective plunger 29, 30 prevent the plunger from passing through the end face 26. Suitable guides (no shown) are formed on the back of the end face 26 behind the apertures to guide movement of the plungers in the apertures 27, 28. The plungers 29, 30 are biased into the apertures by respective biassing springs 33, 34 which extend from the plungers to the pushbar 23. The springs are held in position in the pushbar by way of retaining terminals 35, 36 that are received in and pass through receiving apertures 37, 38 formed in the pushbar 23.

When the pushbar is in its "on" position the retaining terminals 35, 36 make electrical contact with supply terminals 39, 40 on a backing plate 41. The supply terminals 39, 40 extend through the backing plate to present screw terminals, of which terminal 42 can be seen in FIG. 6, for making a connection to an electrical power supply. Thus, when the pushbar 23 is in its "on" position electrical contact is made between the supply terminals 39, 40 and the respective plungers 29, 30.

The pushbar 23 also has formed in it an elongate aperture 43, arranged to receive an interlock member 44. The interlock member 44 is biased away from the backing plate 41 by a spring 45 which is received in a bore 46 formed in the backing plate.

When the lampholder is assembled, the backing plate 41 engages with a supporting rim 47 or other suitable means on the main body 22 and encloses the pushbar 23, the interlock member 44, the plungers 29, 30, etc. within the main body 22. When the lampholder is assembled, studs 48, 49 (see also FIG. 7) cooperate with camming surfaces 50, 51 on the backing plate 41 to provide a positive switching action when the pushbar 23 is moved between its "on" and "off" positions. Also, when the lampholder is assembled, the interlock member extends through the aperture 43 in the pushbar 23 and through a slot 52 in the end face 26 of the main body 22. As with the apertures 27, 28, the slot 52 may be provided with suitable guides formed on the back of the end face to guide movement of the interlock member 44 in the slot 52.

Figure 7A:
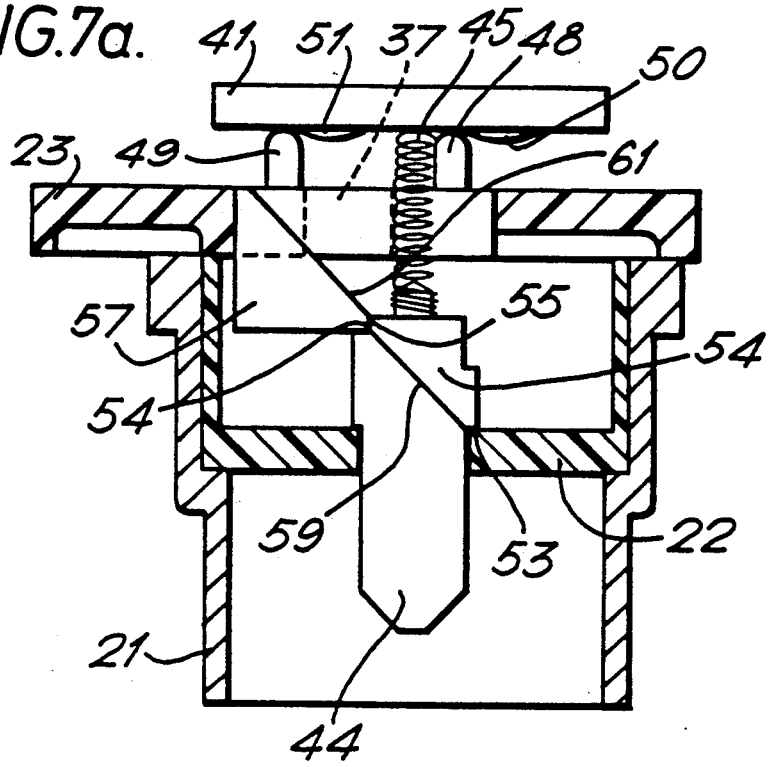
FIG. 7 shows a sectional view of the second lampholder in the "off" position.
FIG. 7*b* shows a sectional view of the second lampholder in the "on" position. Several cross-sections have been omitted for the sake of clarity.
Figure 7B:
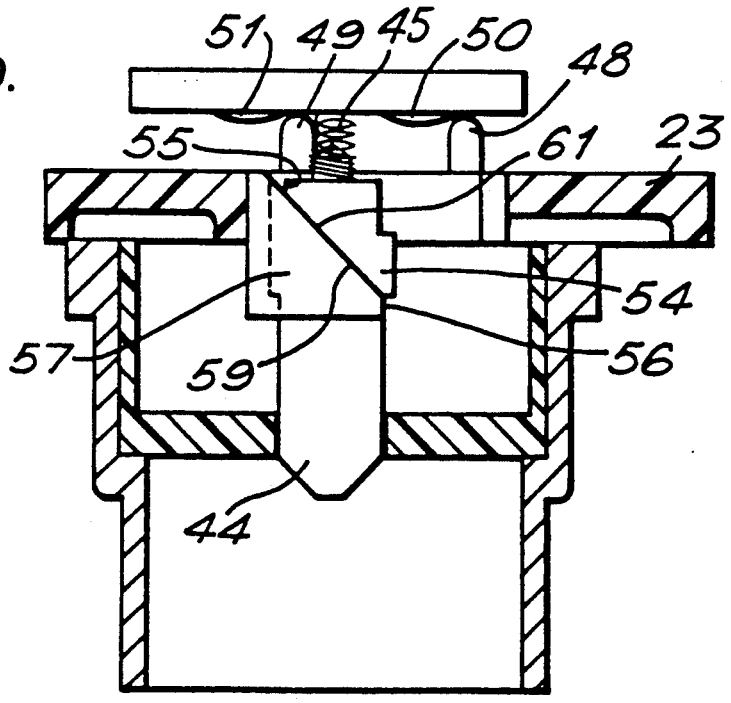

Turning now to FIG. 7(*a*), which shows a section view of the lampholder, it can be seen that when there is no lamp in the lampholder the interlock member is pushed away from the backing plate 41 by the spring 45, such that a ridge 53 on a detent portion 54 of the interlock member abuts the rear of the end face 26 and a stop face 55 on the interlock member contacts a stop face 56 formed on wedged limbs 57, 58 (see FIG. 6) on the pushbar 23. In this position, the switching mechanism is off, i.e., no electrical contact is made between the retaining terminals 25, 26 and the supply terminals 39, 40. The pushbar is prevented from being moved from this position by said cooperation between the stop faces 54 and 55 of the interlock member and the pushbar.

When a lamp (not shown) is inserted into the lampholder, the interlock member 44 is moved by the base of the lamp connector toward the backing plate 41 to the position shown in FIG. 7(*b*). When the interlock member 44 is in this position, the detent portion 54 is positioned in aperture 43 such as to allow movement of the pushbar 23 between the "on" and "off" positions. In FIG. 7(*b*) the pushbar 23 is shown in its "on" position.

As in the previously described embodiment, in the event that a lamp is removed from the lampholder when the pushbar is in the "on" position, the pushbar 23 is moved automatically to the "off" position. The detent portion 54 of the interlock member 44 defines inclined faces, 59, 60 (see also FIG. 6) which cooperate with similarly inclined faces 61, 62 on the wedged limbs 57, 58 of the pushbar. As the lamp is removed, the spring 45 urges the interlock member 44 through the aperture 52 in the end face 26. The inclined faces 59, 60 on the interlock member push against the inclined faces 61, 62, and the force of the spring 45 is sufficient to overcome the effect of the cams 50 and studs 48, thereby urging the pushbar to its off position, as shown in FIG. 7(*a*). to include further locking arrangements, such as the arrangement disclosed in our abovementioned previous application, wherein the pushbar also includes a tee member which extends into a guiding channel and is prevented from moving therein by a collar on the plunger when a lamp is removed from the holder.

The pushbar may also be shortened so that only one end protrudes from the body, and only when the pushbar is in its "off" position. This modification would be particularly suited to pendant lampholders and the like where the supply of electricity is normally controlled by a remote switch. Under such circumstances, the lampholder would only need to be switched off when a lamp was being removed for replacement. The protruding part of the pushbar could be brightly colored, say red, and labelled as a "reset" mechanism with instructions to reset the lampholder after the replacement of a lamp.

Furthermore, while the exemplary embodiments are lampholders, the invention may be applicable to any electrical connector having an on/off switch mechanism.

I claim:

1. An electrical connector comprising:

(a) a body;

(b) a receiving portion defined axially in said body adapted for receiving a cooperating device;

(c) a switch mechanism movable transversely in said body between an "off" position and an "on" position for switchably providing electrical power to said cooperating device received in said receiving portion; and (d) a locking member positioned within said body and having an elongate interlock member extending to said switch mechanism, the locking member being adapted to move axially in response to said cooperating device being inserted in said receiving portion from a first position at which the elongate interlock member prevents the switch mechanism from being moved from the "off" position to the "on" position to a a second position at which the switch mechanism can be moved between the "off" position and the "on" position.

2. An electrical connector as claimed in claim 1, wherein the locking member comprises a collar which extends into said receiving portion, the collar having an end portion adapted to abut a peripheral portion of said cooperating device when said cooperating device is inserted into the receiving portion in order to urge the locking member axially in the body from said first position to said second position.

3. An electrical connector as claimed in claim 1, wherein the locking member comprises a bar which extends into said receiving portion and is adapted to abut an end portion of said cooperating device when said cooperating device is inserted into the receiving portion in order to urge the locking member axially in the body from said first position to said second position.

4. An electrical connector as claimed in claim 1, further comprising an electrical terminal connectable to an electrical supply, a contact member in the receiving portion for delivering electrical power to the cooperating device, and wherein the switch mechanism comprises a switching pushbar switchable between said "on" position and said "off" position, and means by which electrical contact can be made between said electrical terminal and said contact member.

5. An electrical connector as claimed in claim 4, wherein the pushbar has an aperture cooperating with an end portion of the elongate interlock member.

6. An electrical connector as claimed in claim 5, wherein a wedge is formed in the end portion to define an angled surface and a correspondingly angled face is defined in the aperture, the angled surface acting against the angled face to cause the pushbar to be moved to its "off" position during removal of said cooperating device from the receiving portion.

7. An electrical connector as claimed in claim 1, further comprising biasing means for baising the locking member toward said first position.

8. An electrical connector as claimed in claim 3, wherein the biasing means comprise a compression spring.

9. An electrical connector as claimed in claim 1, wherein the locking member comprises detent means for limiting movement for preventing rotation of said locking member within said body.

* * * * *